United States Patent [19]

Wain

[11] 4,054,279

[45] Oct. 18, 1977

[54] THREE-WAY VISE

[76] Inventor: Harry C. Wain, Hampden Road, Somers, Conn. 06071

[21] Appl. No.: 745,308

[22] Filed: Nov. 26, 1976

[51] Int. Cl.[2] ..... B25B 1/04

[52] U.S. Cl. ..... 269/154; 269/239

[58] Field of Search ..... 269/152, 154, 155, 239, 269/237

[56] References Cited

U.S. PATENT DOCUMENTS

| | | | |
|---|---|---|---|
| 1,497,107 | 6/1924 | Lasell | 269/164 |
| 1,859,920 | 5/1932 | Haskins | 269/239 |
| 2,553,700 | 5/1951 | Brooker | 269/237 |
| 3,504,906 | 4/1970 | Hart | 269/239 |

*Primary Examiner*—Robert C. Watson

*Attorney, Agent, or Firm*—Prutzman, Hayes, Kalb & Chilton

[57] ABSTRACT

A three-way vise of this invention includes a pair of workpiece clamping jaws mounted on a frame in substantially perpendicular relation to one another, and a pivotable clamping jaw is supported on the frame for applying a clamping force onto the workpiece in a direction angularly inclined to the other jaws. An adjustable jaw pressing device is provided for selectively urging the pivotable clamping jaw into engagement with the workpiece with increased clamping force after the three jaws are initially engaged with the workpiece.

5 Claims, 3 Drawing Figures

THREE-WAY VISE

This invention generally relates to a vise and particularly concerns a vise for use in clamping a rock to be cut by a diamond blade rock cutting saw or slab saw.

A primary object of this invention is to provide a new and improved vise which effects significantly increased clamping forces for gripping a workpiece and which is quickly and easily operated to effectively clamp the workpiece without its slipping or twisting, e.g., during a cutting operation.

Another object of this invention is to provide such a vise particularly suited for use with a diamond blade rock cutting saw and which vise is flexible and quickly and easily adjustable to accommodate a wide range of irregularly shaped workpieces such as rocks of different sizes.

A further object of this invention is to provide a new and improved three-way vise for clamping rocks to be cut and which is readily set up and released in minimum time and has no requirements for wooden spacers and shims as frequently encountered in conventional vises of this type.

A still further object of this invention is to provide a vise of the type described which features three workpiece engaging jaws but requires tightening and untightening only one jaw to effectively clamp and release a workpiece.

Other objects will be in part obvious and in part pointed out more in detail hereinafter.

A better understanding of this invention will be obtained from the following detailed description and the accompanying drawings of illustrative applications of this invention.

Figure 1:
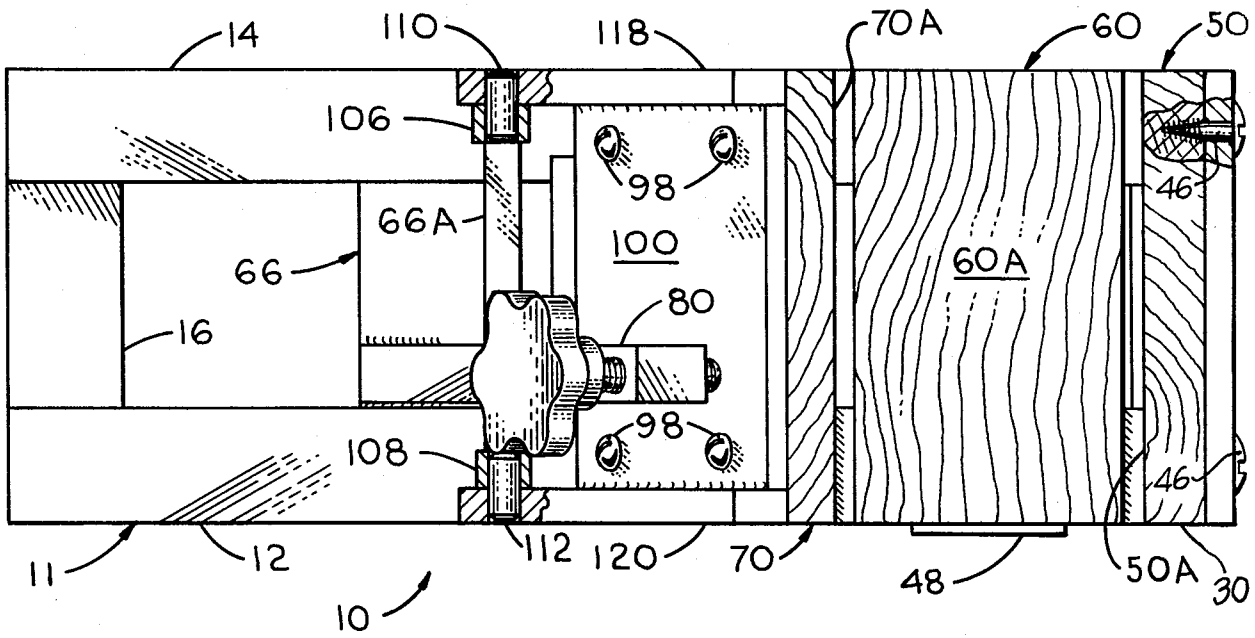
FIG. 1 is a plan view of a vise incorporating this invention.

Referring now to the drawings in detail, a three-way vise 10 is shown incorporating this invention. The vise 10 includes a frame 11 having parallel spaced guide rails 12, 14. To provide a strong rigid frame construction, corresponding ends of rails 12, 14 are connected to one another by cross bars 16, 18 respectively fixed at opposite ends of rails 12, 14.

Figure 2:
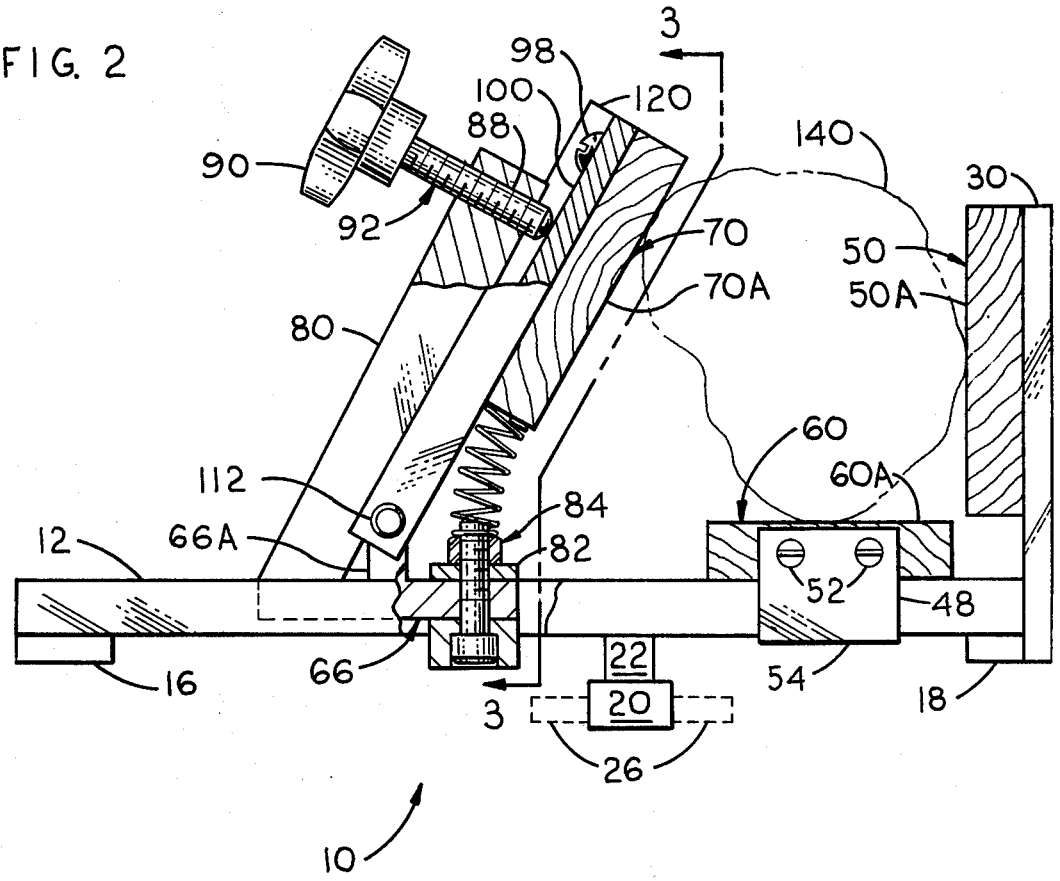
FIG. 2 is a side view, partly broken away and partly in section, of the vise of FIG. 1.

Frame 11 is mounted to be adjustably positioned on a fixed vise support 19 shown in broken lines in FIG. 2. To move frame 11 in a direction parallel to the longitudinal axes of cross bars 16, 18, a cross feed bar 20 is secured below each guide rail 12 and 14 to spacer blocks such as the one shown at 22 fixed to the bottom of rail 12 between its ends. Cross feed bar 20 extends parallel to cross bars 16, 18 with a predetermined clearance provided between guide rails 12, 14 and bar 20. Cross feed bar 20 is supported for movement between a pair of guide blocks shown in broken lines at 26, fixed on the vise support 19. Bar 20 is connected to a drive mechanism, not shown, to adjust the position of frame 11 in a direction parallel to cross bars 16, 18. End plate 30 serves as an upright support for a fixed jaw 50 which is preferably provided with a replaceable flat hardwood clamping face 50A shown secured to plate 30 by wood screws 46.

A slidable jaw 60 having a clamping face 60A, also preferably comprised of hardwood, is horizontally positioned to extend between and over upper surfaces of guide rails 12 and 14. An L-shaped metal clip such as the one shown at 48 will be understood to be fixed by wood screws 52 to each side of clamping face 60A with a horizontal guide leg 54 of each clip 48 projecting under its guide rail to maintain clamping face 60A in position on rails 12, 14 while at the same time permitting the slidable jaw 60 to be moved along rails 12, 14 into desired position without twisting.

Figure 3:
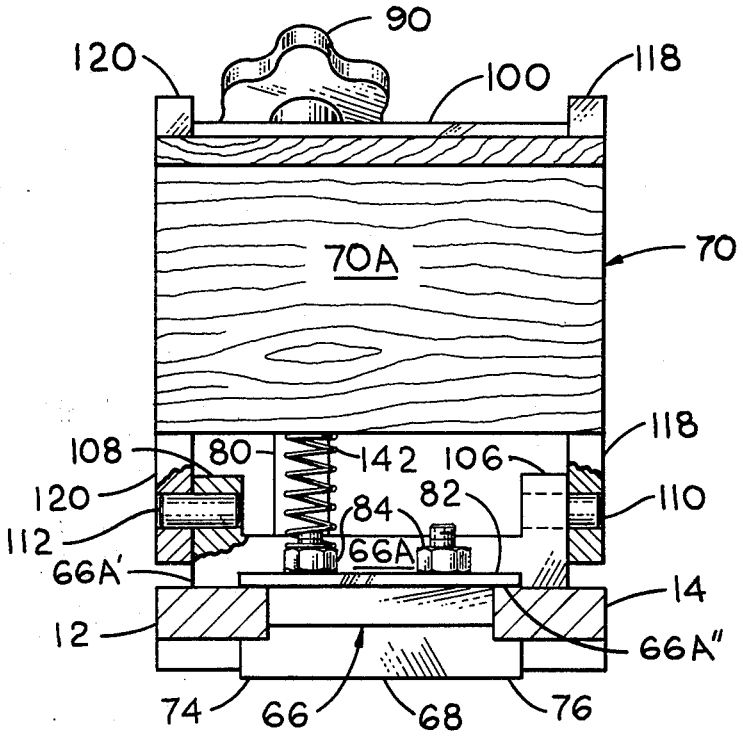
FIG. 3 is a section view taken generally along lines 3—3 of FIG. 2.

Vise 10 of this invention further includes a pivotable jaw 70 which is also slidably movable between rails 12, 14 for selectively positioning jaw 70 along an axis of movement extending parallel to rails 12, 14. Jaw 70 has a sliding base 66 disposed between rails 12, 14. As best seen in FIG. 3, base 66 is connected by suitable fasteners 84 to an inverted T-shaped guide 68. Guide 68 co-extensively extends across the bottom of base 66 with end flanges 74 and 76 of guide 68 projecting in opposite directions underneath the lower surfaces of guide rails 12 and 14, with the flanges 74, 76 serving as guide and bearing surfaces.

To provide guidance and bearing support along upper surfaces of rails 12, 14, an upper guide plate 82 is secured by fasteners 84 on base 66 between rails 12, 14 and over their adjacent upper surfaces.

At the rear of base 66 is an angularly inclined arm or bar 80 which is attached, preferably by welding. Bar 80 has a tapped throughbore 88 adjacent its upper free end for receiving a shank of an adjusting screw 92 manually rotatable by a knob 90 fixed to the screw 92.

Extending across base 66 between rails 12, 14 is a jaw mounting member 66A integrally formed on base 66 to project above an upper surface of base 66 between the guide rails 12, 14 below its jaw support bar 80. For supporting jaw 70 for pivotal movement, a jaw clamping plate 100 is provided with side rails 118, 120 connected by pivot pins 110, 112 to lugs 106, 108 fixed on opposite ends of rail 66A. Pins 110, 112 define a pivot axis for plate 100 and jaw clamping surface 70A which is also preferably formed of a block of hardwood secured to plate 100 by screws 98.

The novel clamping action of this invention will be best understood with reference to workpiece or rock 140 which is to be clamped by faces 50A, 60A and 70A. Initially, the slidable jaw clamping face 60A is moved into a desired position to support workpiece 140 with fixed jaw clamping face 50A also engaging workpiece 140. Base 66 of bar 80 is then moved into position such that the pivotable clamping face 70A additionally engages workpiece 140. It is to be understood that the clearance between rails 12, 14 and cross feed bar 20 is sufficient to permit freedom of travel of guide 68 to a selected position on rails 12, 14. Knob 90 then may be simply turned such that the free end of screw 92 drives plate 100 in a clockwise direction as viewed in FIG. 2 and urges its clamping face 70A to pivot in the same angular direction about the pivot axis defined by pins 110, 112. Such action effects a positive locking grip upon workpiece 140 which results from clamping forces from three non-colinear directions to drive the clamping faces into the rock 140 with sufficient force to embed the rock in the material of the clamping surfaces 50A, 60A and 70A.

As knob 90 is turned to urge the free end of screw 92 against plate 100 to clamp the rock 140, the threaded engagement of the screw 92 within its tapped bore 88 urges bar 80 in a counterclockwise rotation. This action results in positively locking base 66 in position on rails 12, 14 by the combined force of jaw mounting member 66A being urged downwardly into pressing engagement with upper surfaces of guide rails 12, 14, and guide 68 being pressed upwardly into contact with the lower surfaces of guide rails 12, 14, i.e., flanges 74, 76 of guide 68 bear upwardly against the lower surfaces of rails 12, 14 when rock 140 is clamped, and 66A', 66A" refer to flanges projecting from jaw mounting member 66A that bear downwardly on the upper surfaces of rails 12, 14 responsive to screw 92 being tightened down onto plate 100 to clamp face 70A against rock 140. It will be understood that the positive locking action of the base 66 onto the rails 12, 14 increase as the clamping force exerted by jaw 70 is increased.

Such clamping action effectively resists the considerable forces that may be applied by a saw blade, e.g., during a rock cutting operation. Accordingly, the frequently encountered twisting of a workpiece is virtually eliminated which additionally minimizes blade damage, costly blade replacement and resulting downtime occasioned by the blade damage.

To release workpiece 140, it is necessary to simply turn knob 90 in the opposite angular direction which releases the pivotable jaw 70 from the guide rails 12, 14 and permits the jaw 70 to slide away from the workpiece to permit its removal and replacement with the next workpiece. If desired the vise 10 may be provided with a jaw support spring as shown at 142 to maintain the plate 100 and its clamping face 70A in an angular attitude to the horizontally disposed sliding jaw clamping surface 60A upon release of the vise 10.

Thus, the workpiece clamping action of this invention leads naturally to a position locking feature which contributes to a firm, reliable grip on rock 140 when subjected to substantial cutting forces.

It is seen that a novel and unique vise is provided for diamond blade rock cutting saws which exerts pressure from three directions to eliminate workpiece twisting under the force of sawing. Vise 10 is quickly adjustable to accommodate a wide range of workpiece sizes, and eliminates the need for wooden spacers and shims common to the prior art.

As will be apparent to persons skilled in the art, various modifications, adaptations and variations of the foregoing specific disclosure can be made without departing from the teachings of this invention.

I claim:

1. A workpiece clamping vise comprising a frame, a fixed jaw secured to the frame, a base and a sliding jaw mounted on the frame for sliding movement toward and away from the fixed jaw, a rigid angularly inclined arm secured to and projecting from the base toward said fixed jaw, a clamping jaw disposed in overlying relation to the sliding jaw and pivotally supported on the base for swinging movement toward and away from the fixed jaw, and jaw pressing means mounted on the rigid arm of the base for selectively pressing the clamping jaw toward the fixed and sliding jaws to positively lock the jaws and the workpiece in relation to the frame.

2. The vise of claim 1 wherein said frame includes a pair of elongated, spaced parallel rails, wherein the fixed jaw is secured to and extends above the rails, wherein the base is mounted for sliding movement on the rails and has bearing support surfaces engaging upper and lower rail surfaces, and wherein said jaw pressing means includes an extendible and retractable screw threadably engaging the arm of the base, said jaw pressing screw being extendible when the workpiece is clamped between the jaws for driving the pivotally mounted clamping jaw into pressing engagement with the workpiece and simultaneously urging the bearing support surfaces of the base into locking engagement with said upper and lower rail surfaces.

3. The vise of claim 1 wherein the sliding jaw is supported for sliding movement on the rails between the fixed jaw and the base of the pivotable jaw, the sliding jaw having a clamping surface contained in a plane extending parallel to the rails.

4. The vise of claim 3 wherein the sliding jaw, the clamping jaw and the fixed jaw each have a replaceable, substantially flat clamping surface made of wood.

5. The vise of claim 3 wherein rail engaging guide means are provided on the sliding jaw and the base for resisting twisting movements thereof on the rails.

* * * * *